US009418649B2

(12) United States Patent
Kharod et al.

(10) Patent No.: US 9,418,649 B2
(45) Date of Patent: Aug. 16, 2016

(54) METHOD AND APPARATUS FOR PHONETIC CHARACTER CONVERSION

(75) Inventors: Manish G. Kharod, Tampa, FL (US); Bhaskar R Gudlavenkatasiva, Tampa, FL (US); Nityanand Sharma, Tampa, FL (US); Sutap Chatterjee, Tampa, FL (US); Ganesh Bhathivi, Wesley Chapel, FL (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 635 days.

(21) Appl. No.: 13/413,190

(22) Filed: Mar. 6, 2012

(65) Prior Publication Data

US 2013/0238338 A1 Sep. 12, 2013

(51) Int. Cl.
*G10L 13/08* (2013.01)

(52) U.S. Cl.
CPC ..... *G10L 13/08* (2013.01)

(58) Field of Classification Search
CPC ..... G10L 13/00; G10L 13/02; G10L 13/04; G10L 13/08; G10L 15/22; H04M 2201/40; H04M 3/493
USPC ..... 704/258, 260
See application file for complete search history.

(56) References Cited

U.S. PATENT DOCUMENTS

| | | | | |
|---|---|---|---|---|
| 5,890,117 | A * | 3/1999 | Silverman | 704/260 |
| 5,917,890 | A * | 6/1999 | Brotman et al. | 379/88.01 |
| 6,629,071 | B1 * | 9/2003 | Mann | 704/251 |
| 7,143,037 | B1 * | 11/2006 | Chestnut | 704/251 |
| 2010/0076968 | A1 * | 3/2010 | Boyns et al. | 707/732 |

* cited by examiner

*Primary Examiner* — Angela A Armstrong

(57) ABSTRACT

A method and apparatus for improved approaches for uttering the spelling of words and phrases over a communication session is described. The method includes determining a character to produce a first audio signal representing a phonetic utterance of the character, determining a code word that starts with a code word character identical to the character, and generating a second audio signal representing an utterance of the code word, wherein the first audio signal and the second audio signal are provided over a communication session for detection of the character.

21 Claims, 10 Drawing Sheets

METHOD AND APPARATUS FOR PHONETIC CHARACTER CONVERSION

BACKGROUND INFORMATION

Utterances of words or phrases, particularly names and places, can be difficult to understand for a listener if the speaker's manner of speech is not customary to the listener. Intelligibility can be further compromised in the case that the speaker is talking over a poor communication channel. This is especially critical in the conduct of a transaction over, for example, a telephone session, affecting the accuracy of the transaction as well as introducing unnecessary delays in the transaction. Further, the user experience can be frustrating if the information cannot be conveyed efficiently, and result in abandonment of the transaction altogether.

Therefore, there is a need for improved approaches for uttering the words and phrases over a communication session.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DESCRIPTION OF THE PREFERRED EMBODIMENT

A preferred method and system for uttering the spelling of words and phrases over a communication session is described. In the following description, for the purposes of explanation, numerous specific details are set forth in order to provide a thorough understanding of the preferred embodiments of the invention. It is apparent, however, that the preferred embodiments may be practiced without these specific details or with an equivalent arrangement. In other instances, well-known structures and devices are shown in block diagram form in order to avoid unnecessarily obscuring the preferred embodiments of the invention.

Although various exemplary embodiments are described with respect to a mobile device, it is contemplated that other equivalent user devices may be used.

Figure 1:
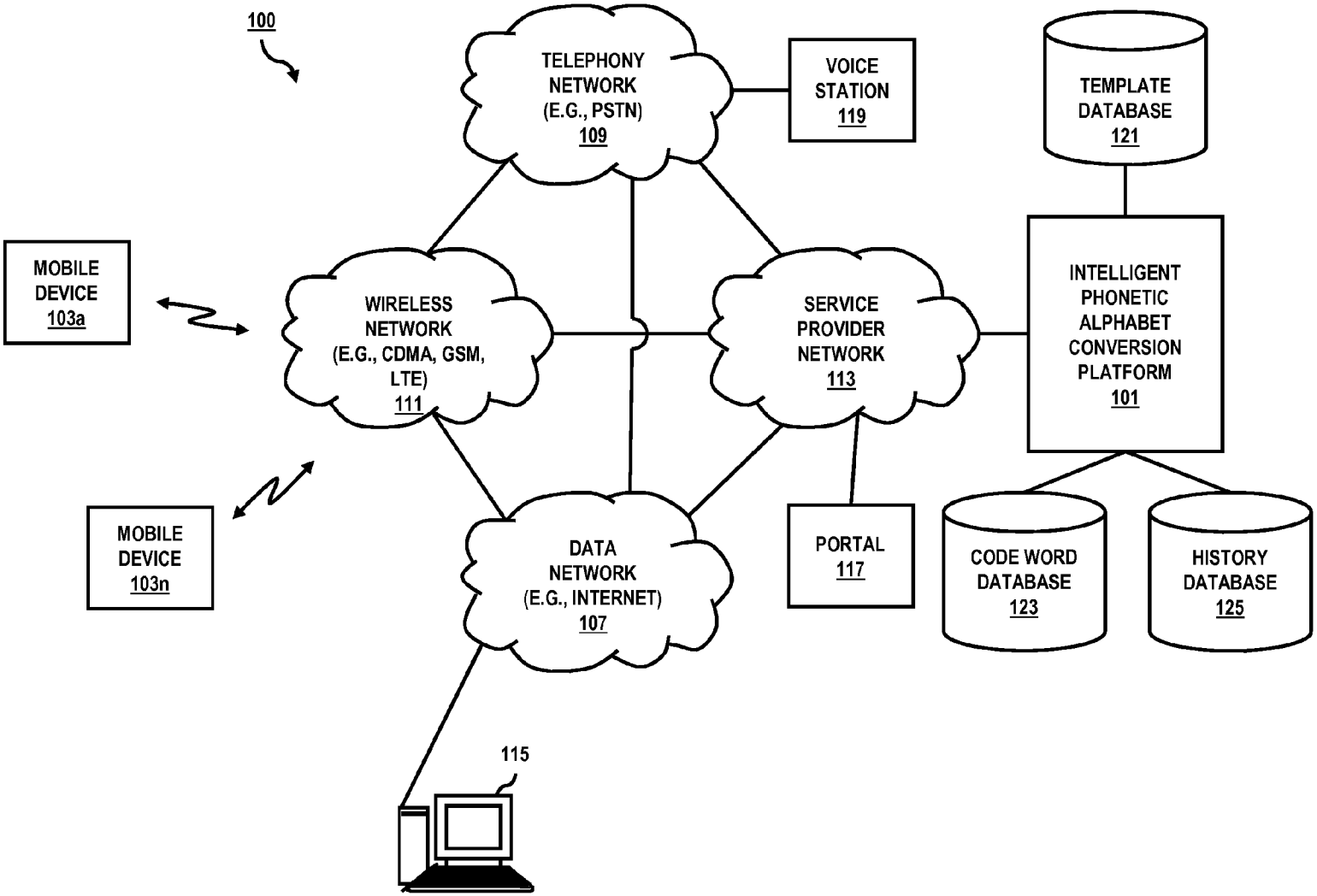
FIG. 1 is a diagram of a communication system capable of identifying a spelling of words and phrases over a communication session, according to various embodiments.

FIG. 1 is a diagram of a communication system capable of uttering the spelling of words over a communication session, according to various embodiments. For illustrative purposes, system 100 is described with respect to an intelligent phonetic alphabet conversion platform 101. In this example, the platform 101 is configured to generate audible sound or utterances of a spelling of a word that is drawn or input via a device, for example, one or more mobile devices 103. The platform 101 determines a character of a word to spell out, selects a code word corresponding to a letter of the word spelled out, generates an audio signal corresponding to the code word and causes one or more of the mobile devices 103 to output the audio signal as an audible sound or utterance via, for example, a speaker (e.g., ear bud, headset, loudspeaker etc.). The uttering of the spelling of words may, for instance, be initiated using one or more user devices (e.g., mobile devices 103) over one or more networks (e.g., data network 107, telephony network 109, wireless network 111, service provider network 113, etc.). In this manner, the platform 101 is configured to efficiently and effectively spell out words, names, addresses and the like over a communication session.

As used herein, mobile devices 103 may be any type of mobile terminal including a mobile handset, mobile station, mobile unit, multimedia computer, multimedia tablet, communicator, netbook, tablet PC, Personal Digital Assistants (PDAs), smartphone, media receiver, etc. It is also contemplated that the mobile devices 103 may support any type of interface for supporting the presentment or exchange of data. In addition, mobile devices 103 may facilitate various input means for receiving and generating information, including touch screen capability, keyboard and keypad data entry, voice-based input mechanisms, accelerometer (e.g., shaking the mobile device 103), and the like. Any known and future implementations of mobile devices 103 are applicable. It is noted that, in certain embodiments, the mobile devices 103 may be configured to transmit information (e.g., audio signals, words, address, etc.) using a variety of technologies—e.g., near field communication (NFC), BLUETOOTH, infrared, etc. Also, connectivity may be provided via a wireless local area network (LAN). By way of example, a group of mobile devices 103 may be configured to a common LAN so that each device can be uniquely identified via any suitable network addressing scheme. For example, the LAN may utilize the dynamic host configuration protocol (DHCP) to dynamically assign "private" DHCP internet protocol (IP) addresses to each mobile device 103, e.g., IP addresses that are accessible to devices connected to the service provider network 113 as facilitated via a router.

In certain embodiments, users may utilize a computing device 115 (e.g., laptop, desktop, web appliance, netbook, etc.) to access platform 101 via service provider portal 117. Service provider portal 117 provides, for example, a web-based user interface to allow users to access the services of platform 101.

According to one embodiment, the alphabet conversion service may be part of managed services supplied by a service provider (e.g., a wireless communication company) as a hosted or subscription-based service made available to users of the mobile devices 103 through a service provider network 113. As shown, platform 101 may be a part of or connected to the service provider network 113. According to another embodiment, platform 101 may be included within or connected to the mobile devices 103, a computing device 115, etc.

As mentioned, users can be met with some confusion or misunderstandings in trying to spell out words, names or addresses over a communication session, such as a telephonic connection. For example, in cases where a service provider utilizes external resources to process service calls (e.g., outsourcing to a foreign call center), the foreign agents, who may possess differing levels of language skills and dialects, may have difficulty communicating with the users. Further, some of the words utilized by the users may not immediately be known to the agent.

To address this issue, the system 100 of FIG. 1 introduces the capability to spell out words or phrases with the assistance of platform 101. By way of example, a user of mobile device 103*a* is engaged in a communication session (e.g., voice session) with a user of another mobile device 103*b*; mobile device 103*a* may receive a selection of words to spell out on the mobile device screen containing frequently spelled words (e.g., name of user, address of user, etc.), and/or words relating to the other user associated with mobile device 103*b*. Further, platform 101 may be configured to generate an audio signal of code words representing each letter in a spelling of a word to generate an utterance of the spelling (e.g., emit the characters and code words as vocal sound) to the user of mobile device 103*b*. For example, a user establishes a connection using mobile device 103*a* to a service provider via a voice station 119 and platform 101 opens an application on mobile device 103*a* that displays options to spell out information about the user (e.g., name of user, address of user, etc.) and information associated with the service provider (e.g., an account number). Further, once the platform 101 determines a word to spell out (e.g., Main Street), platform 101 causes or generates an utterance of a code word representing each character of the word (e.g., M—Mike, A—Alpha, etc.). In another embodiment, the platform 101 determines one or more words to read a word or phrase (e.g., Main Street), and causes the utterance of the word or phrase. Such utterances may be generated, for example, by outputting an audible signal using a speaker located on a mobile device, a speaker located on a wired/wireless headset tethered or paired to a mobile device, and the like. It is contemplated that an audible signal may be further processed (e.g., amplified) before uttering.

As used herein, a "communication session," in some embodiments, includes voice-based communications, e.g., voice calls, audio streams, media streams, etc. In one embodiment, user devices (e.g., mobile devices 103, computing device 115) are configured to transmit and receive audio signals, and access the one or more networks 107-113 to utilize the services of platform 101 to identify and utter code words (e.g., B as in Bravo). For example, such devices 103 (e.g., a netbook, a tablet PC), may communicate with a user associated with a plain old telephone service device, e.g., voice station 119, with access to only telephony network 109. In another embodiment, the devices may initiate a communication session via a video conferencing (or video telephony) protocol and/or application (e.g., SKYPE, GOOGLE TALK, FACETIME, etc.). In this instance, the devices 103 may receive input via a touch screen (or keyboard, mouse, etc.), causing the platform 101 to generate and produce utterances of code words into the communication session. By way of example, platform 101 causes an output of audible sound corresponding to an audio file representing code words on one of the devices via a loud speaker and another of the devices via a bone conduction headset. Additionally, or alternatively, the devices 103 may send and receive a graphical representation of the determined input. For example, a name can be input into the netbook and displayed on the screen on the device 103. It is contemplated that a graphical representation of identifying a spelling of words and phrases may be transmitted via, for example, one or more networks, Short Messaging Service (SMS) text, a connection associated with the communication session, and the like.

Figure 5A:
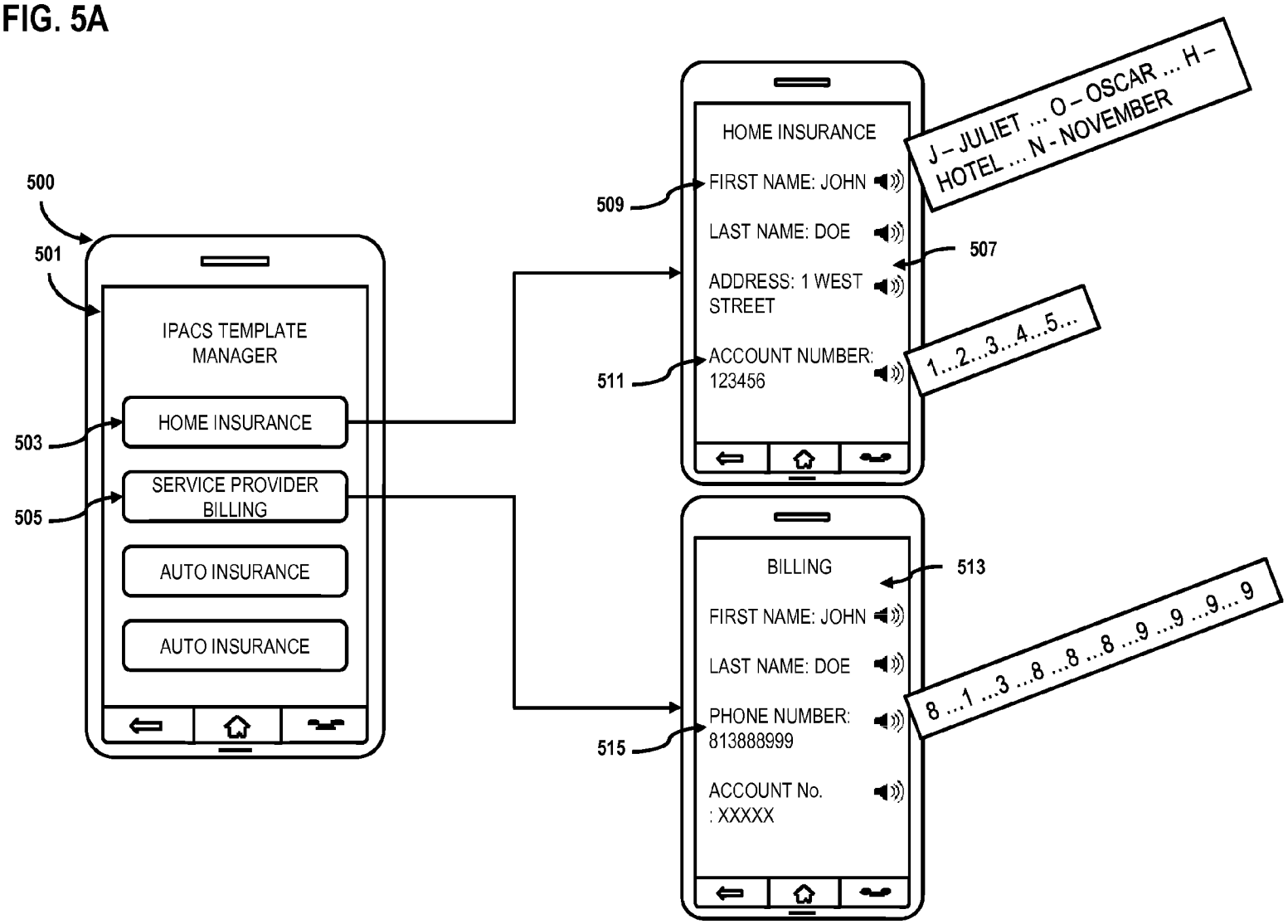
FIGS. 5A and 5B are illustrations of one embodiment for using templates to identify a particular spelling.
Figure 5B:
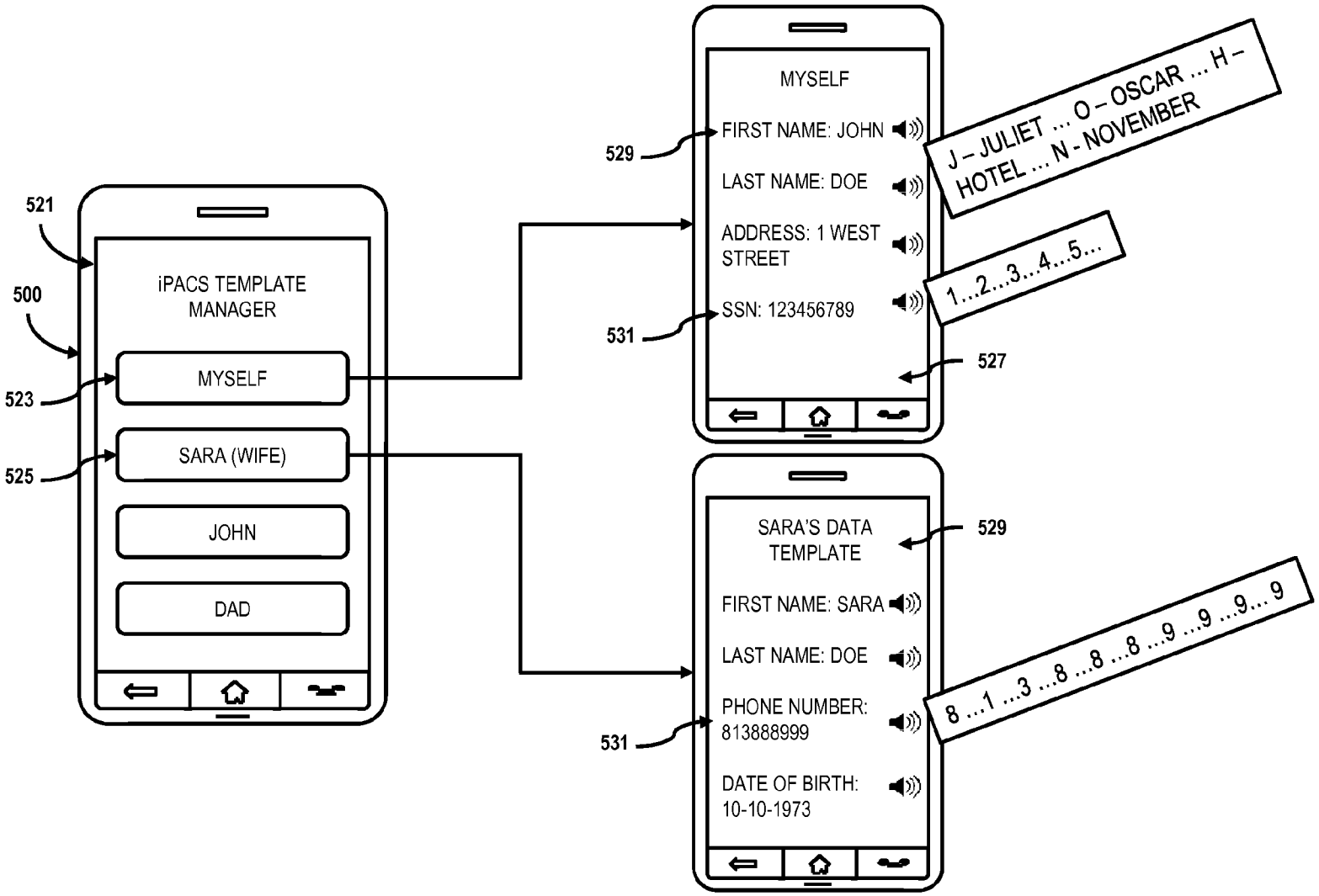

In certain embodiments, platform 101 may include or have access to templates in a template database 121. For example, a template can include fields (e.g., user name, user address, etc.) allowing an input of values (e.g., John Doe, West Street, etc.). In one embodiment, a template can be pre-filed to contain words (or values) to be spelled out, and the user selects a word. For example, the template database 121 may have stored a template with values previously input by the user. In another embodiment, a template contains fields that a user may input words to be spelled. In this manner, a template associated with a product, service, or organization may be retrieved to enable a user to input values (e.g., words, addresses, etc.) associated with the user. Users (or subscribers) may create or modify (e.g., add, delete, modify) fields in a template. It is contemplated that a user may have access to templates associated with more than one group (family, corporation, etc.), as shown in FIG. 5A, and a device can be associated with more than one user, as shown in FIG. 5B.

In certain embodiments, platform 101 may include or have access to code words stored in a code word database 123. For example, platform 101 may access the code word database 123 to select a code word starting with a character to be spelled. By way of example, platform 101 generates the code word "alpha" for the character "a." Code words may be customized or selected in real-time to enable the use of code words commonly used by the recipient. For example, a code word "S—Sierra" may be customized or selected to be "S—Shanghai" when it is determined the recipient (e.g., call center) is based in China.

Additionally, platform 101, in some embodiments, may include or have access to a record of use of one or more services provided by platform 101 stored in a history database 125. That is, platform 101 may access the history database 125 to identify words spelled during a conversation, identify parties to a communication session, a date and time of the conversation and the like. By way of example, platform 101 spells out the street "Main" as "M—Mike, A—Alpha, I—India, N—November" and the history database 125 may store the spelled out word (e.g., Main), the code words used (M—Mike, A—Alpha, etc.), the parties, and a date and time of the conversation.

Furthermore, it is contemplated that some or all functions and processes of platform 101 can be executed by other devices, e.g., anyone of mobile devices 103*a*-103*n* or computer 115.

In some embodiments, platform 101, the mobile devices 103, and other elements of the system 100 may be configured to communicate via the service provider network 113. According to certain embodiments, one or more networks, such as the data network 107, the telephony network 109, and/or the wireless network 111, may interact with the service provider network 113. The networks 107-113 may be any suitable wireline and/or wireless network, and be managed by one or more service providers. For example, the data network 107 may be any local area network (LAN), metropolitan area network (MAN), wide area network (WAN), the Internet, or any other suitable packet-switched network, such as a commercially owned, proprietary packet-switched network, such as a proprietary cable or fiber-optic network. For example, computing device 115 may be any suitable computing device, such as a VoIP phone, skinny client control protocol (SCCP) phone, session initiation protocol (SIP) phone, IP phone, personal computer, softphone, workstation, terminal, server, etc. The telephony network 109 may include a circuit-switched network, such as the public switched telephone network (PSTN), an integrated services digital network (ISDN), a private branch exchange (PBX), or other like network. For instance, voice station 119 may be any suitable plain old telephone service (POTS) device, facsimile machine, etc. Meanwhile, the wireless network 111 may employ various technologies including, for example, code division multiple access (CDMA), long term evolution (LTE), enhanced data rates for global evolution (EDGE), general packet radio service (GPRS), mobile ad hoc network (MANET), global system for mobile communications (GSM), Internet protocol multimedia subsystem (IMS), universal mobile telecommunications system (UMTS), etc., as well as any other suitable wireless medium, e.g., microwave access (WiMAX), wireless fidelity (WiFi), satellite, and the like.

Although depicted as separate entities, the networks 107-113 may be completely or partially contained within one another, or may embody one or more of the aforementioned infrastructures. For instance, the service provider network 113 may embody circuit-switched and/or packet-switched networks that include facilities to provide for transport of circuit-switched and/or packet-based communications. It is further contemplated that the networks 107-113 may include components and facilities to provide for signaling and/or bearer communications between the various components or facilities of the system 100. In this manner, the networks 107-113 may embody or include portions of a signaling system 7 (SS7) network, Internet protocol multimedia subsystem (IMS), or other suitable infrastructure to support control and signaling functions.

While specific reference will be made thereto, it is contemplated that the system 100 may embody many forms and include multiple and/or alternative components and facilities.

Figure 2:
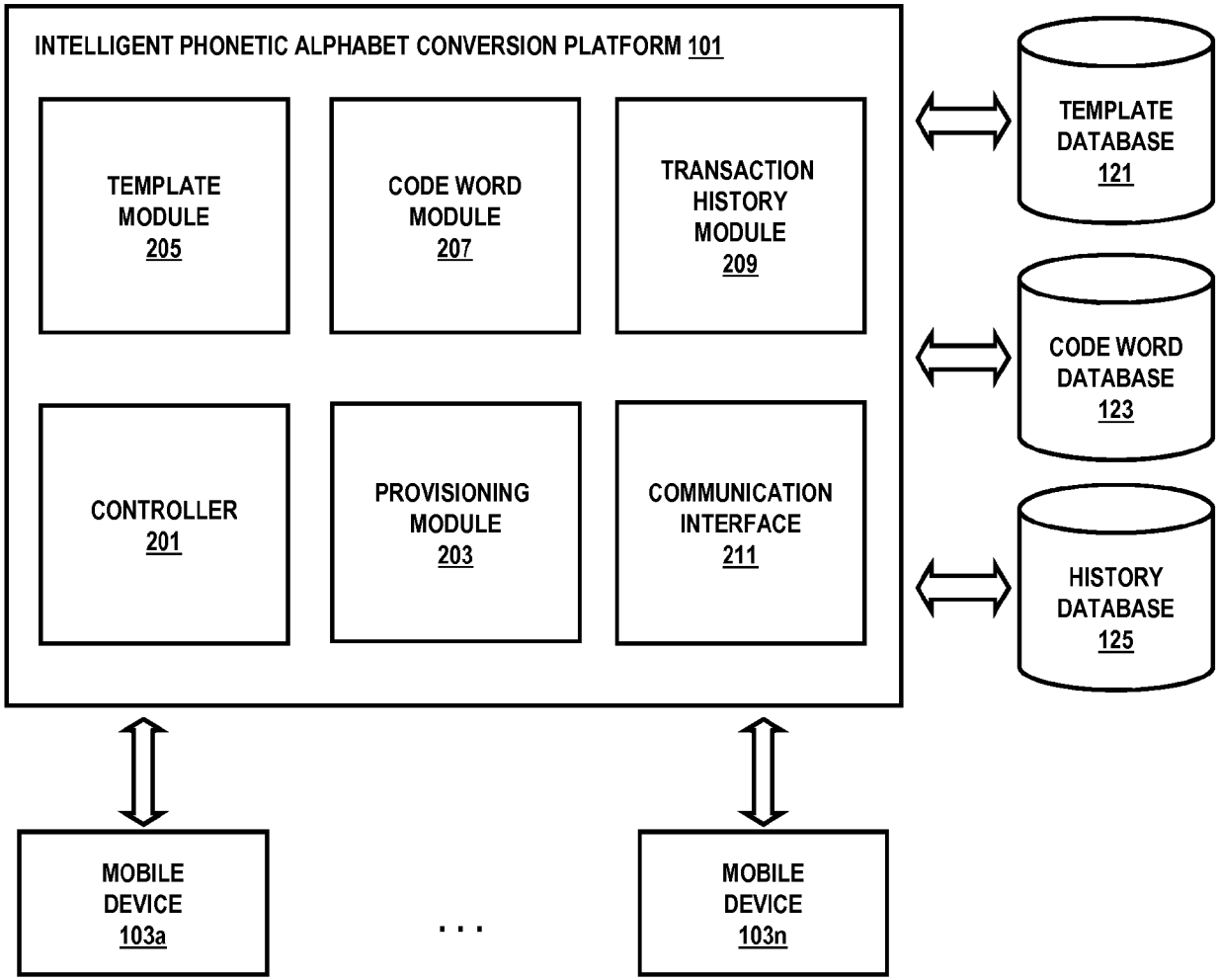
FIG. 2 is a diagram of the components of a phonetic character conversion platform, according to an exemplary embodiment.

FIG. 2 is a diagram of the components of platform 101, according to an exemplary embodiment. The platform 101 may comprise computing hardware (such as described with respect to FIGS. 7 and 8), as well as include one or more components configured to execute the processes described herein for uttering the spelling of words over a communication session. It is contemplated that the functions of these components may be combined in one or more components or performed by other components of equivalent functionality. In one implementation, platform 101 includes a controller 201, provisioning module 203, template module 205, code word module 207, transaction history module 209, and communication interface 211.

The controller 201 may execute at least one algorithm for executing functions of platform 101. For example, the controller 201 may interact with the communication interface 211 to identify a communication session and an associated contacted party (e.g., a product or service provider). Using information regarding the contacted party (e.g., a phone number) the template module 205 may identify templates that are available to a user and related to the contacted party. The controller 201 may then interact with the code word module 207 to select a set or list of code words using a geographical location associated with the contacted party and the controller 201 may then further cause the transaction history module 209 to store a transcript of the communication session.

The provisioning module 203 may deliver mobile content to the mobile device 103 to enable a spelling (or reading) of words and phrases over a communication session. The provisioning module 203 may also update, for example, the version, language settings, or type of installation for platform 101. By way of example, mobile device 103*a* may detect an initiation of a communication session (e.g., a dialing of a contact number) and cause the retrieval of a template associated with the communication session (e.g., a template associated with the contact number.).

The template module 205 may create, modify, or select a template stored in the template database 121. In one embodiment, a first user (or subscriber) generates a template containing one or more fields (e.g., name, address, phone number, etc.) and a second user (or subscriber) inputs values (e.g., a user name, a user address, etc.) into the fields. In this manner, a group, service provider, product manufacturer and the like may generate template forms used by other users (e.g., customers). In another embodiment, a user generates a template by inputting fields and values. Additionally, a template may be shared by multiple users (e.g., a group), and such a template may have group fields (e.g., fields that are shared by users of the group) and user fields (e.g., fields that are unique to users or not universally shared by users).

Templates may be created or modified during, before or after a communication session. In one embodiment, a user can receive a template before a communication session, and may pre-fill the template by entering values into fields. In another embodiment, a communication session starts and the platform 101 sends a template to the user device, which fills or auto-populates the field values. In yet another embodiment, a communication session ends and the platform 101 sends the template to a user with values filled for that user based on user preferences or user profile. That is, the platform 101 determines the values based on the communication session, for example, by use of voice recognition, or by detecting an input by another user. In this manner, templates can be automatically pre-filled. It is noted that security questions may be used to validate the response before engaging into service related questions.

According to one embodiment, platform 101 may include a code word module 207 for selecting code words. As noted, code words are selected to represent a character of a spelling of a word (e.g., the code word begins with a character identical to the character represented). As mentioned, code words may be stored in the code word database 123. The code word module 207 may be configured to select a list or set of code words based on a default setting, a determined location, a detected error, or settings associated with a user. In one embodiment, a code word is selected from a predetermined or default list, such as a NATO phonetic alphabet. In another embodiment, a code word list is selected first, and a code word is selected from the code word list. By way of example, a user calling a call center located in a foreign country can select a code word list that contains words commonly used or known in that country (e.g., S for Shanghai). In another embodiment, a code word list can be customized based on a user input or based on a failed to acknowledge message. For example, a user may customize or select a code word (e.g., B for Bob). In another example, the platform 101 determines that a code word has failed to be interpreted by another (e.g., by an input indicating a failed attempt) and the platform 101 selects another code word to represent the character (e.g., S—Shanghai rather than S—Sierra). It is contemplated that the platform 101 can be configured to replace code words (e.g., select a different code word) in real-time (e.g., within a communication session).

According to one embodiment, platform 101 may include a transaction history module 209 for preserving a record of the services provided by the platform 101. In one embodiment, the platform 101 may generate a transcript of words spelled during a conversation. In another embodiment, the platform 101 may generate and send a portion or all of a transcript to another user. For example, the platform 101 may generate an e-mail indicating the words spelled out during a conversation with a service provider, and send the e-mail to the user (or subscriber), the service provider, and another user (e.g., friend, family member, supervisor, etc.). It is contemplated that the transaction history module 209 can be configured to store all the words spelled during a conversation, all the code words used during a conversation (and their corresponding characters), an indication of the parties of the conversation (e.g., contact number, name, address, etc.), a time and date of the conversation, and the like. In this manner a user can check words spelled during a conversation (e.g., communication session, face-to-face meeting, etc.) and may notify a respective customer service agent to make necessary corrections.

The platform 101 may further include a communication interface 211 to communicate with other components of platform 101, the mobile devices 103, and other components of the system 100. The communication interface 211 may include multiple means of communication. For example, the communication interface 211 may be able to communicate over short message service (SMS), multimedia messaging service (MMS), internet protocol, instant messaging, voice sessions (e.g., via a phone network), email, near field communications (NFC), QR code, or other types of communication. Additionally, communication interface 211 may include a web portal (e.g., service provider portal 117) accessible by, for example, mobile device 103, computing device 115 and the like.

It is contemplated that to prevent unauthorized access, platform 101 may utilize an authentication identifier when transmitting signals to mobile devices 103. For instance, control messages may be encrypted, either symmetrically or asymmetrically, such that a hash value can be utilized to authenticate received control signals, as well as ensure that those signals have not been impermissibly alerted in transit. As such, communications between the mobile devices 103 and platform 101 may include various identifiers, keys, random numbers, random handshakes, digital signatures, and the like.

Figure 3:
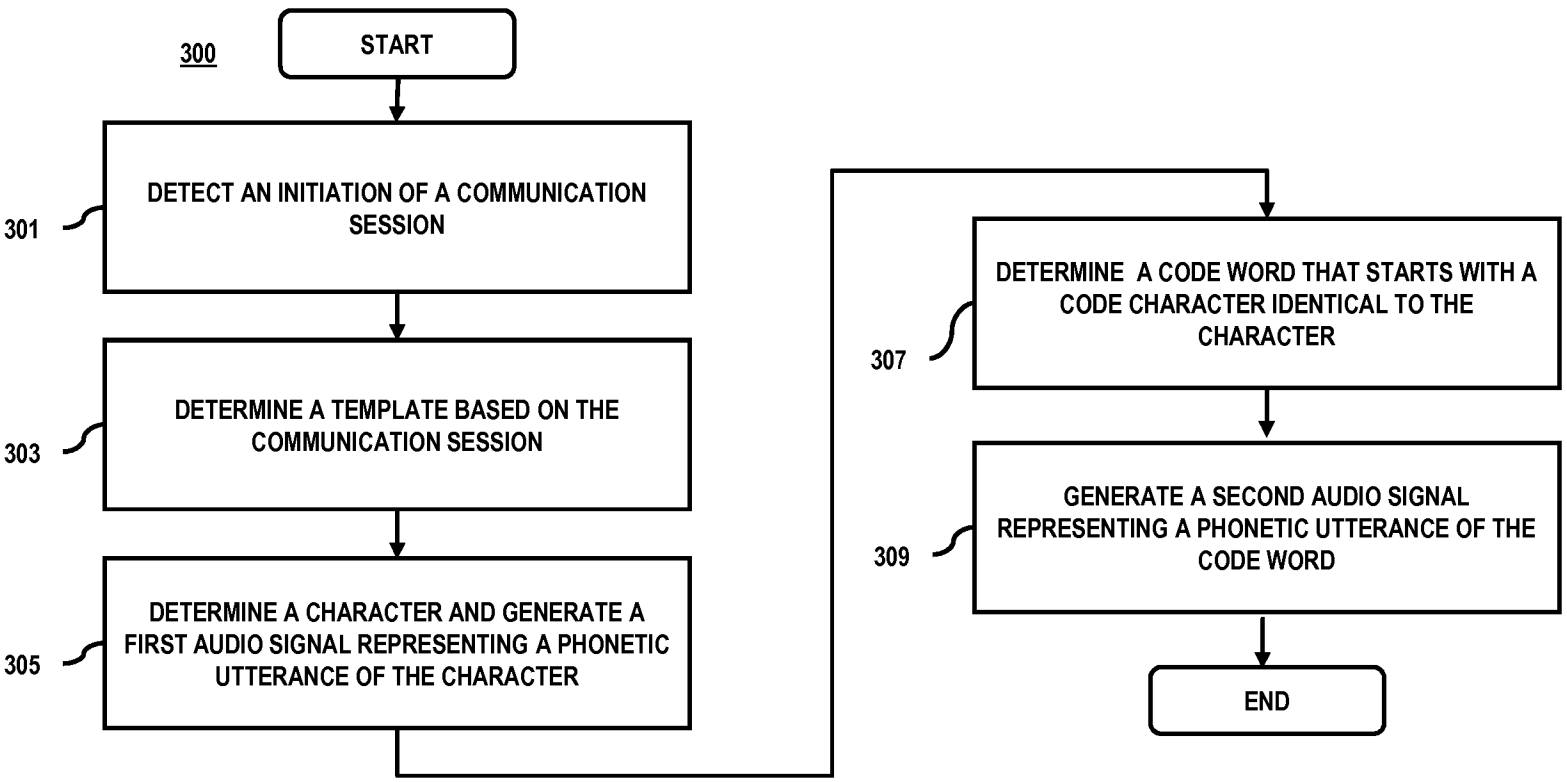
FIG. 3 is a flowchart of a process for identifying a spelling of words and phrases over a communication session, according to one embodiment.

FIG. 3 is a flowchart of a process for providing for identifying a spelling of words and phrases over a communication session, according to an exemplary embodiment. For illustrative purpose, process 300 is described with respect to the systems of FIGS. 1 and 2. It is noted that the steps of process 300 may be performed in any suitable order, as well as combined or separated in any suitable manner. The process 300 may be performed by platform 101, in one embodiment; e.g., in particular, code word module 207. In step 301, the process 300 detects an initiation of a communication session (e.g., a voice session) between, for example, mobile device 103*a* and voice station 119. The initiation of the communication session may be using any of the means described with respect to the communication interface 211, and may include any information indicating a request to establish the communication session, for example, the dialing of a number on mobile device 103*a*, answering a call initiated by voice station 119, and the like. Additionally, the opening of an application associated with a communication session on, for example, computing device 115 (e.g., a multimedia table device) may be detected as an initiation of a communication session to be used, for example, in a face-face meeting. Once the process 300 detects the initiation of a communication session request, process 300 determines, as in step 303 a template based on the communication session. In one embodiment, a template is determined based on one or more parties of the communication session. For example, a telephonic connection to a certain service provider causes the platform 101 to determine a template that is associated (e.g., created by) with the certain service provider. In another example, a template can be determined based on an identification of a user (or subscriber), for example, by use of a log-in procedure and a determination of a called party (e.g., the certain service provider). In this manner, individual users (or subscribers) of platform 101 may have separate templates. In another embodiment, step 303 determines a template based on a detection of information indicating a template (e.g., the scanning of a QR code associated with a template, the receiving of an SMS text message indicating a template, detection of a user input, etc.). In this manner information stored on a template can be quickly identified, for example, in case of emergencies.

After the template has been determined, the process 300 determines, as in step 305, a character and generates a first audio signal representing a phonetic utterance of the character. In one embodiment, the character is determined by an input (e.g., selection of a key on a hard keyboard, selection of a key on a soft keyboard, or a drawing) into mobile device 103*a*. In another embodiment, the determined template includes one or more characters (or words to be spelled out), and the character is determined based on a detection of an input into computing device 115 indicating a selection of a character or word to be spelled out. For example, a screen displaying "Last Name: White" causes the character "W" to be determined along with a first audio signal representing the utterance of "W," followed by the character "H" to be determined along with a first audio signal representing the utterance of "H," and so forth. In this manner, a user can avoid multiple key strokes to spell out details. It is contemplated that the words may also be read rather than spelled out.

The process 300 then determines, as in step 307, a code word representing the determined character. In one embodiment, a code word is selected based on the first character of the code word being identical to the determined character. For example, a code word "Alpha" is determined for a character "A," a code word "Bravo" is determined for a character "B," and so forth. In another embodiment more than one code word has a first character that is identical to the determined character and the code word is determined based on, for example, a determined template, a determined geographical location, an indication of a failed attempt to detect a character from the code word, or a combination thereof. By way of example, the process 300 may determine code words "Delta" and "Delhi" for the character "D," and select "Delta" based on a determination that the template prefers the use of the NATO phonetic alphabet ("Delta" is a code word in the NATO phonetic alphabet). In another embodiment, the determined geographical location of a called party (e.g., the call center, service provider, etc.) is India; and the process 300 determines "Delhi" based on an association with the code word to the geographical location India (e.g., the process prefers the use of "Delhi" over "Delta" when the called party is located in India.). In another example, the code word module 207 determines that a receiver (e.g., a called party) has failed to acknowledge "Alpha" corresponds to the character "A," and thus step 307 determines another code word to represent the character "A" to the receiver (e.g., "Apple.") It is contemplated that code words and their priority may be customized by groups, users, templates, receivers and the like. Also, other context information can be used in lieu of or in addition to geographical location to select the particular code words.

The platform 101 then generates, as in step 309, a second audio signal representing a phonetic utterance of the code word. The audio signal representing a phonetic utterance may be in any form that may be used to generate a speech synthesis representing the code word including text-to-speech files, audio (e.g., MP3, WMA, ACC, etc.), text files, and the like. In one embodiment, a single device detects inputs selecting characters and produces utterances of audible sound using one or more speakers (e.g., headset and a loudspeaker) without an establishing of a communication session. Such an embodiment may be used during face-to-face conversations, for example, when a customer goes to an appointment to the hospital an application may be configured to read out details with or without spelling out the selected words. In another embodiment, multiple devices of a communication session are utilized wherein one device (e.g., mobile device 103*a*) detects an input selecting characters to produce utterances and another device (e.g., mobile device 103*b* or voice station 119) outputs an utterance or audible sound via a speaker located on a headset wirelessly connected (e.g., paired or bonded) to the another device. Such an embodiment may be used when parties to a communication session are remote from each other.

It is contemplated that a user can customize an output from the platform 101. For example the platform 101 may be configured to utter a word, character, a code word representing the character, or a combination thereof. For example, the platform 101 may cause an uttering or reading aloud the word (e.g., MAIN) followed by uttering each character (e.g., "M," "A," "I," "N"). In another example the platform 101 causes an uttering of the word (e.g., MAIN) followed by uttering each character and code word (e.g., "M—Mike," "A—Alpha," "I—India," "N—November.") Alternatively, or additionally, the platform 101 may be configured to display on a screen an output to be read by the user rather than to generate an audio signal.

It is contemplated that a user may customize an utterance or audible output from the platform 101. In one embodiment, an utterance is produced once the platform 101 generates an audio signal. For example, platform 101 generates an audio output for "M—Mike," and inserts a signal into a communication session that causes "M—Mike" to be output on speakers located on all devices to the communication session (e.g., mobile device 103, computing device 115, voice station 119, etc.). Additionally, or alternatively, the platform 101 may truncate, mute, or otherwise remove other signals, such as those detected by microphones located on devices to the communication session, to facilitate a detection of utterances. In another embodiment, platform 101 generates an audio signal and waits for an event (e.g., an expiration of a timer, a muting of a microphone, an input indicating to cause an utterance, etc.) before causing an utterance. By way of example, platform 101 generates an audio output for "114 Main Street," and inserts a signal that causes devices of a communication session (e.g., all devices except a device used to select the phrase "114 Main Street") to utter "114 Main Street" upon a detection of silence in the communication session (e.g., microphones on devices in the communication session detect no audible sound) or an expiration of a timer (e.g., 10 seconds). In this manner, platform 101 may be configured to utter or output sound in a manner that is not disruptive to users. As illustrated in the foregoing examples, platform 101 may also be configured to cause only a portion or set of devices to a communication session to utter a selected phrase, for example, all devices except a device used to select the phrase to utter. It is contemplated that other features may be customized such as a delay between spelling each code word (e.g., one second delay), a type of synthetic voice (e.g., male, female), and the like.

Figure 4B:
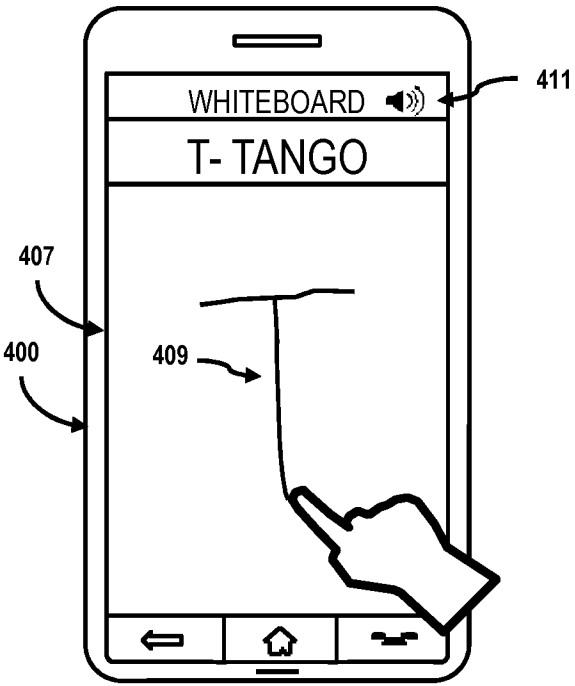
FIGS. 4A and 4B are illustrations of one embodiment for entering in characters to identify a particular spelling.
Figure 4A:
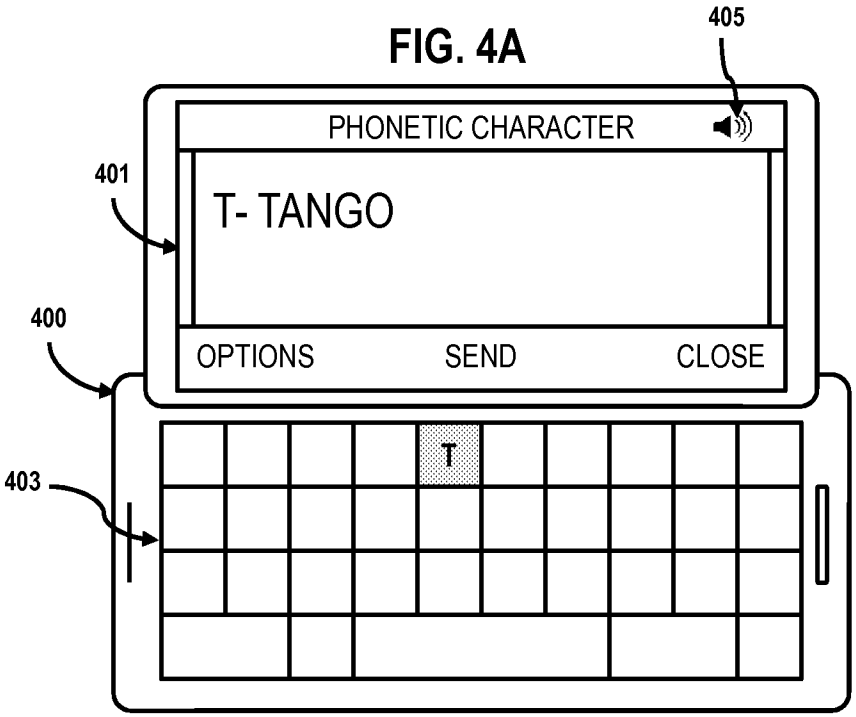

FIGS. 4A and 4B are illustrations of one embodiment for entering in characters to identify a particular spelling. It is contemplated that graphical user interfaces presented in FIGS. 4A and 4B may be implemented on the same device (e.g., mobile device 103).

FIG. 4A illustrates a mobile device 400 (e.g., mobile device 103), and a graphical user interface ("GUI") 401. In the exemplary embodiment, the mobile device 400 contains a hard keyboard 403 that accepts and detects input of characters to spell out (or detects the input of characters to read a word). The GUI 401 includes a mute toggle option 405 that toggles between a first mode where an inputted character causes an uttering of the character and/or a code word corresponding to the character and a second mode that causes the display of the character and/or code word. In this manner, a user opting to speak a code word may benefit from the services of platform 101 by receiving one or more code words corresponding to the character.

FIG. 4B illustrates mobile device 400 (e.g., mobile device 103), and GUI 407. In the exemplary embodiment, GUI 407 accepts and detects a drawing 409 input by a user, for example, on a touch-screen display and determines based on the drawing one or more characters to spell out or one or more characters to read a word. It is contemplated that any character recognition method (e.g., optical character recognition) may be used to determine characters such as numeric (e.g., Arabic, roman numerals), alphabetical (Latin, Arabic, Greek, etc.) and symbolic (e.g., "%," "$," "#," etc.). Similar to GUI 401, GUI 407 includes a mute toggle option 411 that toggles between a first mode where an inputted character causes an uttering of the character and/or a code word corresponding to the character and a second mode that causes the display of the character and/or code word.

FIGS. 5A and 5B are illustrations of one embodiment for using templates to identify a particular spelling. It is contemplated that graphical user interfaces presented in FIGS. 5A and 5B may be implemented on the same device (e.g., mobile device 103).

FIG. 5A illustrates a mobile device 500 (e.g., mobile device 103), and a GUI 501 for selecting a template. In the exemplary embodiment, the GUI 501 includes selectable options 503 and 505. When the mobile device 500 detects an indication selecting selectable option 503, the GUI 501 presents screen 507. Screen 507 includes additional selectable options corresponding to "home insurance" such as selectable options 509 and 511. When selectable option 509 is selected, the first name "John" is spelled out (and/or read out). Likewise, when selectable option 511 is selected, the account number "123456" is spelled out. In this manner, a user can easily store and access information related to a number of accounts (e.g., Home Insurance, Service Provider Billing, Auto Insurance, etc.). Similarly, selecting selectable option 505 causes the GUI 501 to display Screen 513 which includes selectable options corresponding to "Service Provider Billing" such as selectable option 515. When selectable option 515 is selected the phone number associated with Service Provider Billing is read out (e.g., 8, 1, 3, etc.).

FIG. 5B illustrates mobile device 500 (e.g., mobile device 103), and GUI 521 for selecting a user. In the exemplary embodiment, the GUI 521 includes selectable options 523 and 525. When the mobile device 500 detects an indication selecting selectable option 523, the GUI 521 presents screen 527. Screen 527 includes additional selectable options corresponding to "Myself" such as selectable options 529 and 531. When selectable option 529 is selected the first name "John" is spelled out. Likewise, when selectable option 531 is selected the social security number "123456789" is spelled out. It is contemplated that platform 101 may be configured to mask (e.g., encryption, nulling out, deletion) or partially cover sensitive information (e.g., social security number, date of birth, etc.) to protect such information from unauthorized dissemination. Similarly, selecting selectable option 525 causes the GUI 521 to display screen 529, which includes selectable options corresponding to "Sara" such as selectable option 531. In this manner, a template may be for a group (family, corporation, etc.) and be configured to allow each user to input, read, or spell values (e.g., user name, user address, etc.).

Figure 6:
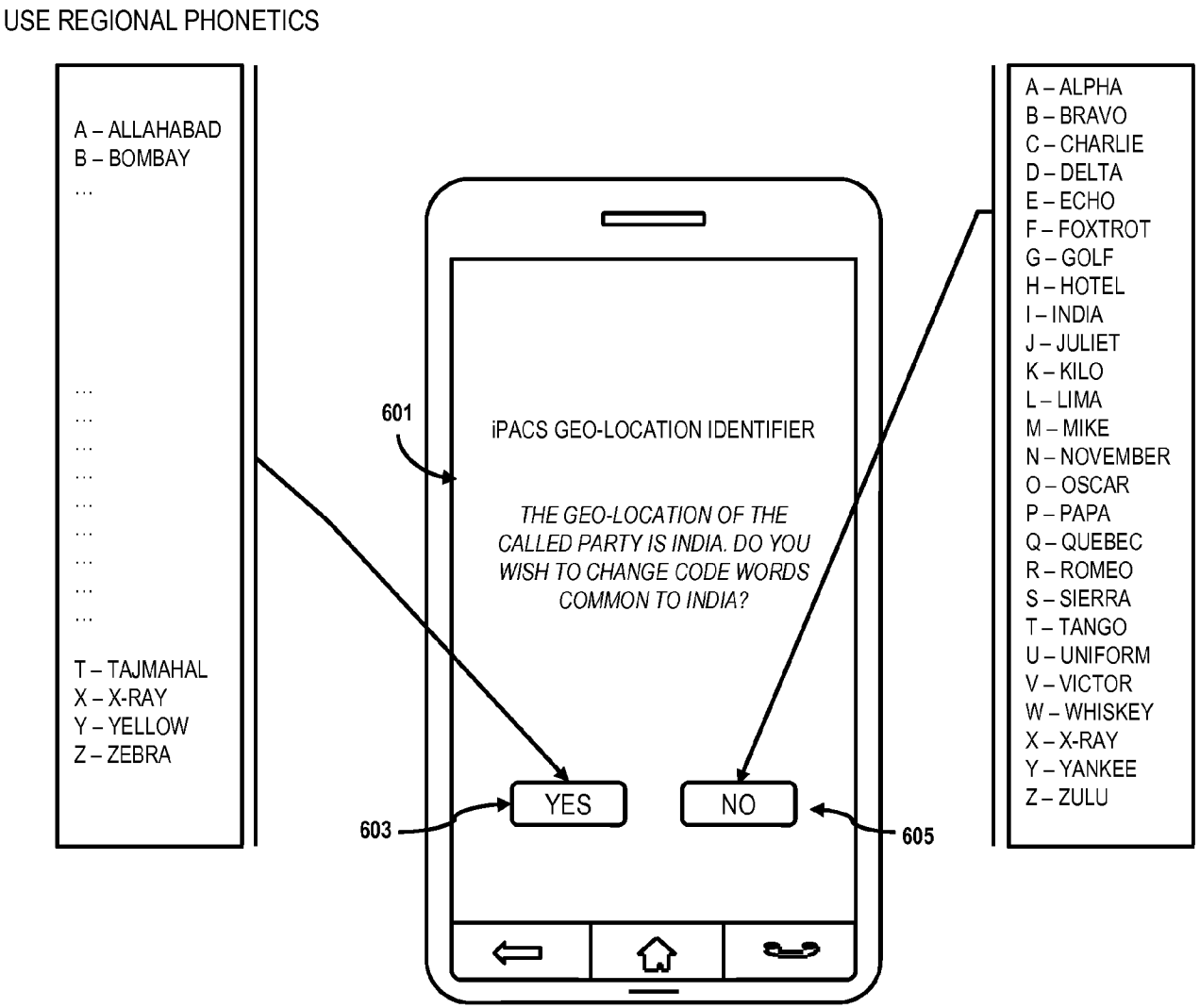
FIG. 6 is an illustration of one embodiment for selecting a set of code words.

FIG. 6 is an illustration of one embodiment for selecting a set of code words. In the exemplary embodiment, the GUI 601 includes selectable options 603 and 605. When selectable option 603 is selected, the code words are determined based on code words associated with selectable option 603 (e.g., A—Allahabad, B—Bombay, etc.). Similarly, when selectable option 605 is selected, the code words are determined based on code words associated with selectable option 605 (e.g., A—Alpha, B—Bravo, etc.).

The processes for uttering the spelling of words and phrases over a communication session described herein may be implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 7:
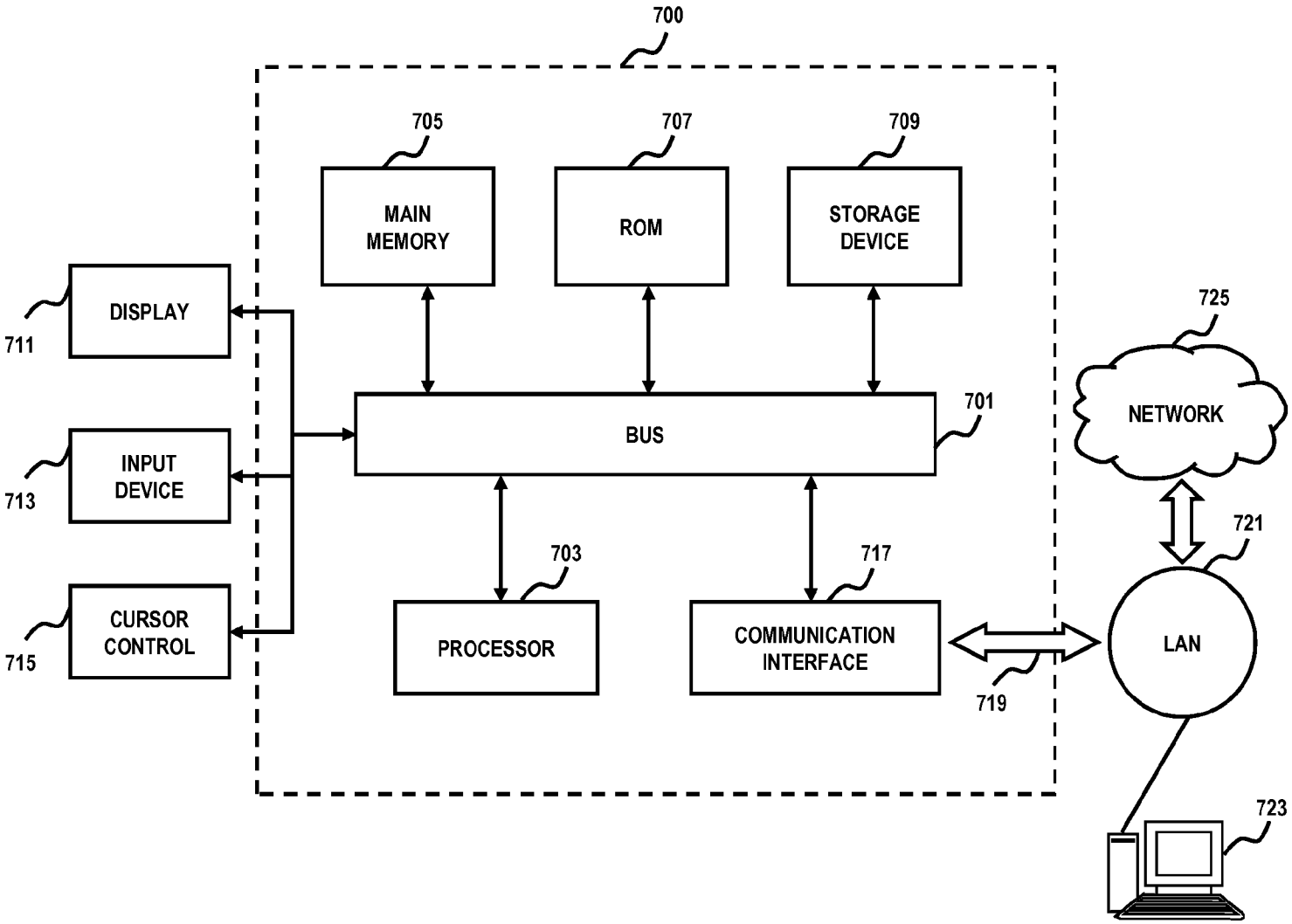
FIG. 7 is a diagram of a computer system that can be used to implement various exemplary embodiments.

FIG. 7 is a diagram of a computer system that can be used to implement various exemplary embodiments. The computer system 700 includes a bus 701 or other communication mechanism for communicating information and one or more processors (of which one is shown) 703 coupled to the bus 701 for processing information. The computer system 700 also includes main memory 705, such as a random access memory (RAM) or other dynamic storage device, coupled to the bus 701 for storing information and instructions to be executed by the processor 703. Main memory 705 can also be used for storing temporary variables or other intermediate information during execution of instructions by the processor 703. The computer system 700 may further include a read only memory (ROM) 707 or other static storage device coupled to the bus 701 for storing static information and instructions for the processor 703. A storage device 709, such as a magnetic disk, flash storage, or optical disk, is coupled to the bus 701 for persistently storing information and instructions.

The computer system 700 may be coupled via the bus 701 to a display 711, such as a cathode ray tube (CRT), liquid crystal display, active matrix display, or plasma display, for displaying information to a computer user. Additional output mechanisms may include haptics, audio, video, etc. An input device 713, such as a keyboard including alphanumeric and other keys, is coupled to the bus 701 for communicating information and command selections to the processor 703. Another type of user input device is a cursor control 715, such as a mouse, a trackball, touch screen, or cursor direction keys, for communicating direction information and command selections to the processor 703 and for adjusting cursor movement on the display 711.

According to an embodiment of the invention, the processes described herein are performed by the computer system 700, in response to the processor 703 executing an arrangement of instructions contained in main memory 705. Such instructions can be read into main memory 705 from another computer-readable medium, such as the storage device 709. Execution of the arrangement of instructions contained in main memory 705 causes the processor 703 to perform the process steps described herein. One or more processors in a multi-processing arrangement may also be employed to execute the instructions contained in main memory 705. In alternative embodiments, hard-wired circuitry may be used in place of or in combination with software instructions to implement the embodiment of the invention. Thus, embodiments of the invention are not limited to any specific combination of hardware circuitry and software.

The computer system 700 also includes a communication interface 717 coupled to bus 701. The communication interface 717 provides a two-way data communication coupling to a network link 719 connected to a local network 721. For example, the communication interface 717 may be a digital subscriber line (DSL) card or modem, an integrated services digital network (ISDN) card, a cable modem, a telephone modem, or any other communication interface to provide a data communication connection to a corresponding type of communication line. As another example, communication interface 717 may be a local area network (LAN) card (e.g. for Ethernet™ or an Asynchronous Transfer Mode (ATM) network) to provide a data communication connection to a compatible LAN. Wireless links can also be implemented. In any such implementation, communication interface 717 sends and receives electrical, electromagnetic, or optical signals that carry digital data streams representing various types of information. Further, the communication interface 717 can include peripheral interface devices, such as a Universal Serial Bus (USB) interface, a PCMCIA (Personal Computer Memory Card International Association) interface, etc. Although a single communication interface 717 is depicted in FIG. 7, multiple communication interfaces can also be employed.

The network link 719 typically provides data communication through one or more networks to other data devices. For example, the network link 719 may provide a connection through local network 721 to a host computer 723, which has connectivity to a network 725 (e.g. a wide area network (WAN) or the global packet data communication network now commonly referred to as the "Internet") or to data equipment operated by a service provider. The local network 721 and the network 725 both use electrical, electromagnetic, or optical signals to convey information and instructions. The signals through the various networks and the signals on the network link 719 and through the communication interface 717, which communicate digital data with the computer system 700, are exemplary forms of carrier waves bearing the information and instructions.

The computer system 700 can send messages and receive data, including program code, through the network(s), the network link 719, and the communication interface 717. In the Internet example, a server (not shown) might transmit requested code belonging to an application program for implementing an embodiment of the invention through the network 725, the local network 721 and the communication interface 717. The processor 703 may execute the transmitted code while being received and/or store the code in the storage device 709, or other non-volatile storage for later execution. In this manner, the computer system 700 may obtain application code in the form of a carrier wave.

The term "computer-readable medium" as used herein refers to any medium that participates in providing instructions to the processor 703 for execution. Such a medium may take many forms, including but not limited to computer-readable storage medium ((or non-transitory)—e.g., non-volatile media and volatile media), and transmission media. Non-volatile media include, for example, optical or magnetic disks, such as the storage device 709. Volatile media include dynamic memory, such as main memory 705. Transmission media include coaxial cables, copper wire and fiber optics, including the wires that comprise the bus 701. Transmission media can also take the form of acoustic, optical, or electromagnetic waves, such as those generated during radio frequency (RF) and infrared (IR) data communications. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Various forms of computer-readable media may be involved in providing instructions to a processor for execution. For example, the instructions for carrying out at least part of the embodiments of the invention may initially be borne on a magnetic disk of a remote computer. In such a scenario, the remote computer loads the instructions into main memory and sends the instructions over a telephone line using a modem. A modem of a local computer system receives the data on the telephone line and uses an infrared transmitter to convert the data to an infrared signal and transmit the infrared signal to a portable computing device, such as a personal digital assistant (PDA) or a laptop. An infrared detector on the portable computing device receives the information and instructions borne by the infrared signal and places the data on a bus. The bus conveys the data to main memory, from which a processor retrieves and executes the instructions. The instructions received by main memory can optionally be stored on storage device either before or after execution by processor.

Figure 8:
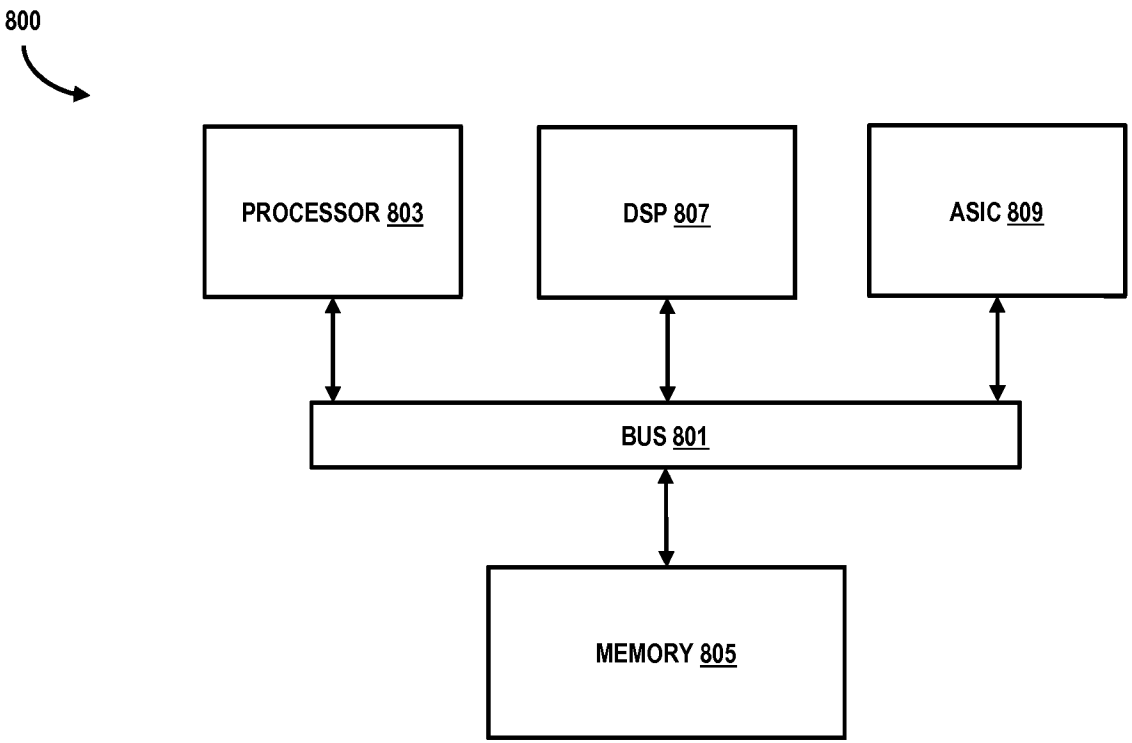
FIG. 8 is a diagram of a chip set that can be used to implement various exemplary embodiments.

FIG. 8 illustrates a chip set or chip 800 upon which an embodiment of the invention may be implemented. Chip set 800 is programmed to enable an uttering of a spelling over a communication session as described herein and includes, for instance, the processor and memory components described with respect to FIG. 7 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 800 can be implemented in a single chip. It is further contemplated that in certain embodiments the chip set or chip 800 can be implemented as a single "system on a chip." It is further contemplated that in certain embodiments a separate ASIC would not be used, for example, and that all relevant functions as disclosed herein would be performed by a processor or processors. Chip set or chip 800, or a portion thereof, constitutes a means for performing one or more steps of enabling the uttering of a spelling over a communication session transfer of a mobile device.

In one embodiment, the chip set or chip 800 includes a communication mechanism such as a bus 801 for passing information among the components of the chip set 800. A processor 803 has connectivity to the bus 801 to execute instructions and process information stored in, for example, a memory 805. The processor 803 may include one or more processing cores with each core configured to perform independently. A multi-core processor enables multiprocessing within a single physical package. Examples of a multi-core processor include two, four, eight, or greater numbers of processing cores. Alternatively or in addition, the processor 803 may include one or more microprocessors configured in tandem via the bus 801 to enable independent execution of instructions, pipelining, and multithreading. The processor 803 may also be accompanied with one or more specialized components to perform certain processing functions and tasks such as one or more digital signal processors (DSP) 807, or one or more application-specific integrated circuits (ASIC) 809. A DSP 807 typically is configured to process real-world signals (e.g., sound) in real time independently of the processor 803. Similarly, an ASIC 809 can be configured to performed specialized functions not easily performed by a more general purpose processor. Other specialized components to aid in performing the inventive functions described herein may include one or more field programmable gate arrays (FPGA) (not shown), one or more controllers (not shown), or one or more other special-purpose computer chips.

In one embodiment, the chip set or chip 800 includes merely one or more processors and some software and/or firmware supporting and/or relating to and/or for the one or more processors.

The processor 803 and accompanying components have connectivity to the memory 805 via the bus 801. The memory 805 includes both dynamic memory (e.g., RAM, magnetic disk, writable optical disk, etc.) and static memory (e.g., ROM, CD-ROM, etc.) for storing executable instructions that when executed perform the inventive steps described herein to enable the uttering of a spelling over a communication session. The memory 805 also stores the data associated with or generated by the execution of the inventive steps.

Figure 9:
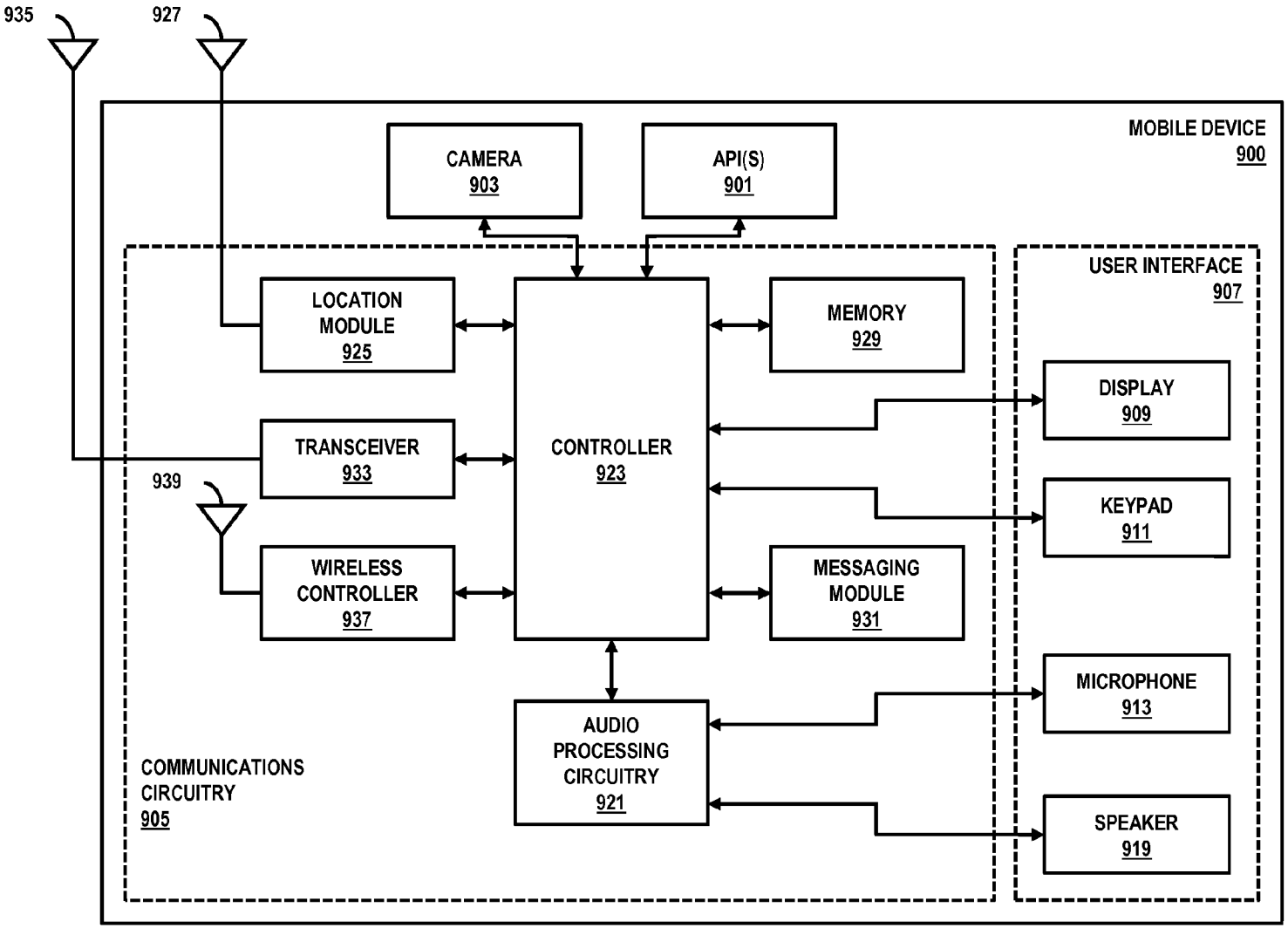
FIG. 9 is a diagram of a mobile device configured to facilitate various exemplary embodiments.

FIG. 9 is a diagram of a mobile device configured to facilitate the uttering of a spelling over a communication session, according to an exemplary embodiment. Mobile device 900 (e.g., equivalent to the mobile device 103) may comprise computing hardware (such as described with respect to FIGS. 7 and 8), as well as include one or more components configured to execute the processes described herein for facilitating the uttering of a spelling over a communication session. In this example, mobile device 900 includes application programming interface(s) 901, camera 903, communications circuitry 905, and user interface 907. While specific reference will be made hereto, it is contemplated that mobile device 900 may embody many forms and include multiple and/or alternative components.

According to exemplary embodiments, user interface 907 may include one or more displays 909, keypads 911, microphones 913, and/or speakers 919. Display 909 provides a graphical user interface (GUI) that permits a user of mobile device 900 to view dialed digits, call status, menu options, and other service information. Specifically, the display 909 may allow viewing of, for example, a template. The GUI may include icons and menus, as well as other text and symbols. Keypad 911 includes an alphanumeric keypad and may represent other input controls, such as one or more button controls, dials, joysticks, touch panels, etc. The user thus can construct templates, enter field values, initialize applications, select options from menu systems, and the like. Specifically, the keypad 911 may enable the inputting of characters and words. Microphone 913 coverts spoken utterances of a user (or other auditory sounds, e.g., environmental sounds) into electronic audio signals, whereas speaker 919 converts audio signals into audible sounds or utterances. A camera 903 may be used as an input device to detect images, for example a QR code.

Communications circuitry 905 may include audio processing circuitry 921, controller 923, location module 925 (such as a GPS receiver) coupled to antenna 927, memory 929, messaging module 931, transceiver 933 coupled to antenna 935, and wireless controller 937 coupled to antenna 939. Memory 929 may represent a hierarchy of memory, which may include both random access memory (RAM) and read-only memory (ROM). Computer program instructions and corresponding data for operation can be stored in non-volatile memory, such as erasable programmable read-only memory (EPROM), electrically erasable programmable read-only memory (EEPROM), and/or flash memory. Memory 929 may be implemented as one or more discrete devices, stacked devices, or integrated with controller 923. Memory 929 may store information, such as contact lists, preference information, and the like. As previously noted, it is contemplated, that functions performed by platform 101 may be performed by the mobile device 900.

Additionally, it is contemplated that mobile device 900 may also include one or more applications and, thereby, may store (via memory 929) data associated with these applications for providing users with browsing functions, business functions, calendar functions, communication functions, contact managing functions, data editing (e.g., database, word processing, spreadsheets, etc.) functions, financial functions, gaming functions, imaging functions, messaging (e.g., electronic mail, IM, MMS, SMS, etc.) functions, multimedia functions, service functions, storage functions, synchronization functions, task managing functions, querying functions, and the like. As such, signals received by mobile device 900 from, for example, platform 101 may be utilized by API(s) 901 and/or controller 923 to facilitate the sharing of information, and improving the user experience.

Accordingly, controller 923 controls the operation of mobile device 900, such as in response to commands received from API(s) 901 and/or data stored to memory 929. Control functions may be implemented in a single controller or via multiple controllers. Suitable controllers 923 may include, for example, both general purpose and special purpose controllers and digital signal processors. Controller 923 may interface with audio processing circuitry 921, which provides basic analog output signals to speaker 919 and receives analog audio inputs from microphone 913.

Mobile device 900 also includes messaging module 931 that is configured to receive, transmit, and/or process messages (e.g., enhanced messaging service (EMS) messages, SMS messages, MMS messages, instant messaging (IM) messages, electronic mail messages, and/or any other suitable message) received from (or transmitted to) platform 101 or any other suitable component or facility of system 100. As such, messaging module 931 may be configured to receive, transmit, and/or process information shared by the mobile device 900. For example, platform 101 can send an SMS information relating to a template, code word, and the like.

It is also noted that mobile device 900 can be equipped with wireless controller 937 to communicate with a wireless headset (not shown) or other wireless network. The headset can employ any number of standard radio technologies to communicate with wireless controller 937; for example, the headset can be BLUETOOTH enabled. It is contemplated that other equivalent short range radio technology and protocols can be utilized. While mobile device 900 has been described in accordance with the depicted embodiment of FIG. 9, it is contemplated that mobile device 900 may embody many forms and include multiple and/or alternative components.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A method comprising:

determining, utilizing a processor, an initiating of a communication session associated with at least one device and at least one user of the at least one device;

determining one or more aspects associated with one of: the communication session, the at least one device, the at least one user and combinations thereof;

determining a template based, at least in part, on the one or more aspects, wherein the template is based on at least one aspect of the one or more aspects associated with a geographical location, a user priority, a group priority, context information or a combination thereof, wherein the template includes at least one field associated with the one or more aspects, the at least one field including at least one of one or more predetermined values associated with the at least one user, an input space for one or more input values associated with the at least one user, and combinations thereof;

determining a character to produce a first audio signal representing a phonetic utterance of the character;

determining a code word that starts with a code word character identical to the character, wherein the determination of the code word is based, at least in part, on the template; and generating a second audio signal representing an utterance of the code word, wherein the first audio signal and the second audio signal are provided over the communication session for detection of the character.

2. The method of claim 1, further comprising:

initiating a selection of the character based, at least in part, on the determination of the initiating of the communication session, wherein the template is associated with a product, a service, an organization or a combination thereof.

3. The method of claim 1, wherein the one or more aspects include a geographical location of the at least one device associated with the communication session.

4. The method of claim 1, wherein the determination of the code word is based on an indication of a failed attempt to detect the character from the second audio signal.

5. The method of claim 1, wherein the determining of the character is based on the template.

6. The method of claim 5, wherein the template is associated with a user, a product, a service, a QR code, or a combination thereof.

7. The method of claim 5, further comprising:

determining a recipient that detects the character, wherein the determining the template is based, at least in part, on the recipient.

8. The method of claim 7, wherein the template includes characters relating to a product or a service associated with the recipient.

9. The method of claim 1, further comprising:

determining the character based on a selection of one or more keys on a hard keyboard, a selection of one or more keys on a soft keyboard, a detection of one or more characters represented by one or more drawings, or a combination thereof.

10. An apparatus comprising:

at least one processor; and at least one memory including computer program code for one or more programs, the at least one memory and the computer program code configured to, with the at least one processor, cause the apparatus to perform at least the following:

determine an initiating of a communication session associated with at least one device and at least one user of the at least one device, determine one or more aspects associated with one of: the communication session, the at least one device, the at least one user and combinations thereof, determine a template based, at least in part, on the one or more aspects, wherein the template is based on at least one aspect of the one or more aspects associated with a geographical location, a user priority, a group priority, context information or a combination thereof, wherein the template includes at least one field associated with the one or more aspects, the at least one field including at least one of one or more predetermined values associated with the at least one user, an input space for one or more input values associated with the at least one user, and combinations thereof, determine a character to produce a first audio signal representing a phonetic utterance of the character, determine a code word that starts with a code word character identical to the character, wherein the determination of the code word is based, at least in part, on the template, and generate a second audio signal representing an utterance of the code word, wherein the first audio signal and the second audio signal are provided over the communication session for detection of the character.

11. The apparatus of claim 10, wherein the apparatus is further caused to:

initiate a selection of the character based, at least in part, on the determination of the initiating of the communication session, wherein the template is associated with a product, a service, an organization or a combination thereof.

12. The apparatus of claim 10, wherein the one or more aspects include a geographical location of the at least one device associated with the communication session.

13. The apparatus of claim 10, wherein the determination of the code word is based on an indication of a failed attempt to detect the character from the second audio signal.

14. The apparatus of claim 10, wherein the determining of the character is based on the template.

15. The apparatus of claim 14, wherein the template is associated with a user, a product, a service, a QR code, or a combination thereof.

16. The apparatus according to claim 14, wherein the apparatus is further caused to:

determine a recipient that detects the character, wherein the determining the template is based, at least in part, on the recipient.

17. The apparatus of claim 16, wherein the template includes characters relating to a product or a service associated with the recipient.

18. The apparatus of claim 10, wherein the apparatus is further caused to:

determine the character based on a selection of one or more keys on a hard keyboard, a selection of one or more keys on a soft keyboard, a detection of one or more characters represented by one or more drawings, or a combination thereof.

19. A system comprising one or more devices configured to:

determine an initiation of a communication session associated with at least one user device and at least one user of the at least one user device, determine one or more aspects associated with one of: the communication session, the at least one user device, the at least one user and combinations thereof, determine a template based, at least in part, on the one or more aspects, wherein the template is based on at least one aspect of the one or more aspects associated with a geographical location, a user priority, a group priority, context information or a combination thereof, wherein the template includes at least one field associated with the one or more aspects, the at least one field including at least one of one or more predetermined values associated with the at least one user, an input space for one or more input values associated with the at least one user, and combinations thereof, detect a selection of a character and transfer audio signals over a communication session, determine the character, generate a first audio signal representing a phonetic utterance of the character, determine a code word that starts with a code word character identical to the character, wherein the determination of the code word is based, at least in part, on the template, and generate a second audio signal representing utterance of the code word.

20. The system of claim 19, wherein the one or more devices are further configured to determine at least one other device associated with the communication session and generate the template based on the at least one other device, wherein the at least one other device is further configured to initiate the selection of the character based on one or more characters associated with the template, wherein the template is associated with a product, a service, an organization or a combination thereof.

21. The system of claim 19, wherein the one or more aspects include a geographical location of the at least one device associated with the communication session.

* * * * *